US005585757A

United States Patent [19]

Frey

[11] Patent Number: 5,585,757

[45] Date of Patent: Dec. 17, 1996

[54] EXPLICIT LOG DOMAIN ROOT-MEAN-SQUARE DETECTOR

[75] Inventor: Douglas R. Frey, Bethlehem, Pa.

[73] Assignec: Analog Devices, Inc., Norwood, Mass.

[21] Appl. No.: 469,446

[22] Filed: Jun. 6, 1995

[51] Int. Cl.[6] ..... G06G 7/20; G06G 7/24

[52] U.S. Cl. ..... 327/348; 327/350

[58] Field of Search ..... 327/350, 346, 327/347, 348, 349

[56] References Cited

U.S. PATENT DOCUMENTS

| | | | |
|---|---|---|---|
| 3,214,603 | 10/1965 | Von Urff, Jr. | 327/346 |
| 3,423,578 | 1/1969 | Platzer, Jr. et al. | 327/348 |
| 3,657,528 | 4/1972 | Plante | 327/348 |
| 4,430,626 | 2/1984 | Adams | 327/350 |
| 5,252,864 | 10/1993 | Kooijman | 327/350 |

OTHER PUBLICATIONS

That 2252 ICRMS–Level Detector Data Sheet, That Corporation, Sep. 1993, pp. 1–10 no month.

D. Sheingold, "Nonlinear Circuits Handbook", Analog Devices, Inc., pp. 398–403, 1976 no month.

National Semiconductor LH0091 True RMS to DC Converter Chip, 1988 no month.

Douglas Frey, "Log Domain Filtering: An Approach to Current Mode Filtering", *IEEE Proceedings*, Pt. G, vol. 140, No. 6, pp. 406–416, Dec. 1993.

*Primary Examiner*—Timothy P. Callahan
*Assistant Examiner*—Eunja Shin
*Attorney, Agent, or Firm*—Koppel & Jacobs

[57] ABSTRACT

An explicit RMS detector sequentially performs the square, mean and square-root operations in the log domain. An input signal is first applied to a log converter, and then to a times two multiplier which squares the input signal. A log filter averages the log square input signal for a predetermined period to approximate the "mean" operation, after which a times one-half multiplier operates on the log mean-square input signal to compute the square root. An exponentiator exponentiates the resulting log root-mean-square input signal to produce an output signal that approximates the RMS value of the input signal for the predetermined period.

2 Claims, 2 Drawing Sheets

EXPLICIT LOG DOMAIN ROOT-MEAN-SQUARE DETECTOR

BACKGROUND OF THE INVENTION

1. Field of the Invention

The present invention generally relates to circuits for computing the root-mean-square (RMS) value of an input signal, and more specifically to an explicit circuit topology that computes the time-varying RMS value of an input signal in the log domain.

2. Description of the Related Art

RMS detectors typically fall into one of two categories: explicit or implicit. Explicit RMS detectors, such as disclosed by D. Sheingold "Nonlinear Circuits Handbook," Analog Devices, Inc., pp. 398–403, 1976, square the input signal, compute its mean, and then calculate the square root. These detectors require a multiplier, an operational amplifier (op amp) and a square-root circuit. The number of components needed to implement each of these circuits reduces the accuracy of the detector. Furthermore, squaring the input signal reduces the dynamic range of the detector.

FIG. 1 is a block diagram of a known implicit RMS detector 10 such as National Semiconductor's LH0091 True RMS to DC Converter chip, 1988. The implicit detector 10 incorporates negative feedback to produce an RMS output signal $V_{out}$. A rectified input voltage signal $V_{in}$ is applied to a logarithm (log) converter 12 which computes the log of the input signal $V_{in}$. A multiplier 14 scales the log $V_{in}$ signal by a factor of two, which is equivalent to squaring $V_{in}$. The log $V_{in}^2$ voltage is applied as a positive input to a summing circuit 16. The detector's output signal $V_{out}$ is fed back through a log converter 18 and is applied as a negative input to the summing circuit 16, which subtracts $V_{out}$ from log $V_{in}^2$ and produces a difference voltage signal $V_d$. An exponentiator circuit 20 performs the inverse operation of the log converter 12 on the difference voltage signal. The exponentiated voltage signal $V_e$ is input to a first order low pass filter 22. To the extent that the low pass filter approximates the "mean" operation, the output voltage signal $V_{out}$ is the RMS of the input voltage signal $V_{in}$.

By processing the input signal in the log domain, the implicit detector improves the detector's dynamic range. However, the high frequency performance of the implicit detector is limited by the negative feedback topology such that the practical bandwidth of the detector is reduced. This topology also increases the number of components, which reduces the detector's accuracy and increases its cost. Furthermore, the feedback topology limits the implicit detector to using a first order low pass filter, which may not produce an adequate frequency response for approximating the "mean" operation for some high frequency input signals.

SUMMARY OF THE INVENTION

The present invention provides an explicit log domain RMS detector having an expanded dynamic range, increased bandwidth and improved accuracy. This is accomplished with a topology that sequentially performs the square, mean and square-root operations in the log domain. An input signal is first applied to a log converter, and then to a times two multiplier which scales the log of the input signal. A log filter averages the log square input signal for a predetermined period to approximate the "mean" operation, after which a times one-half multiplier then operates on the log mean-square input signal to compute the square root. An exponentiator exponentiates the resulting log root-mean-square input signal to produce an output signal that approximates the RMS value of the input signal for the predetermined period.

For a better understanding of the invention, and to show how the same may be carried into effect, reference will now be made, by way of example, to the accompanying drawings.

DETAILED DESCRIPTION OF THE INVENTION

Figure 1:
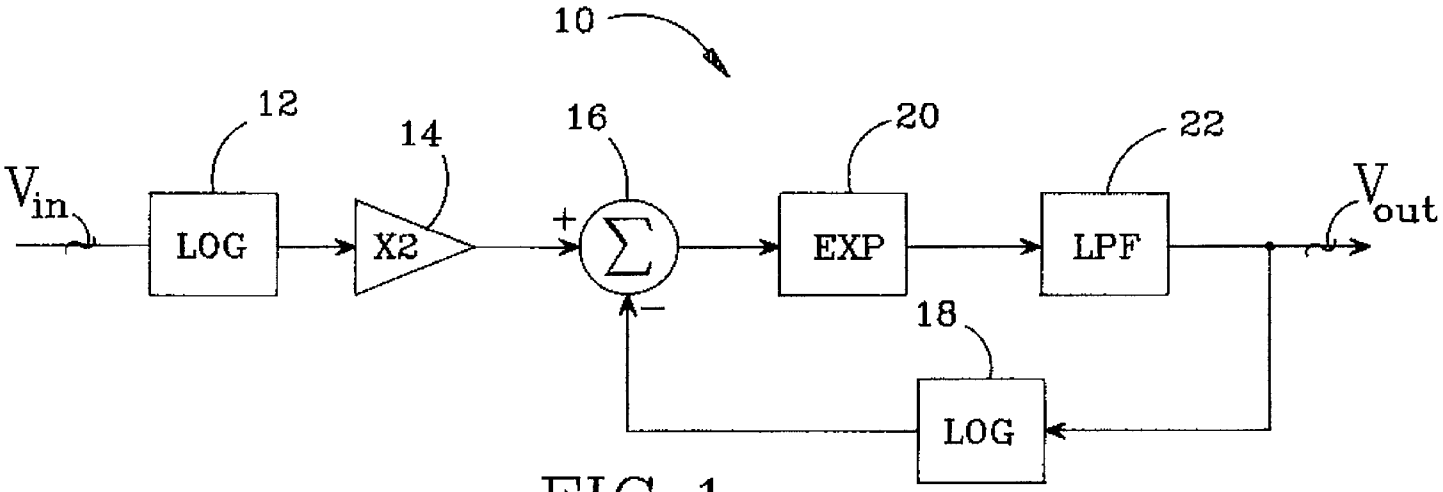
FIG. 1 (Prior Art)
FIG. 1, as described above, is a block diagram of a known RMS detector that implicitly computes an RMS value.
Figure 2:
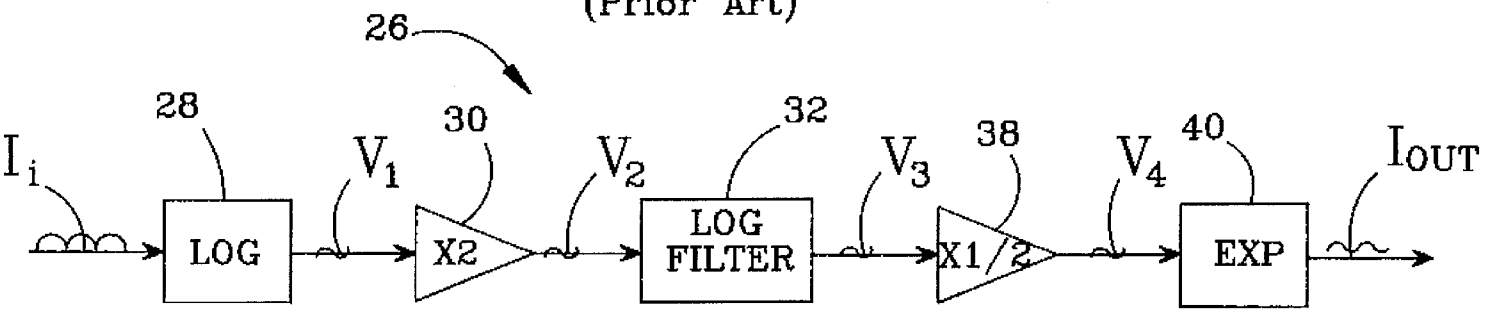
FIG. 2 is a block diagram illustrating the explicit level detector topology of the present invention.

FIG. 2 is a block diagram of an explicit log domain level detector 26. For ease of explanation, we will describe an RMS level detector which computes the root-mean-square of the input signal. The invention is applicable to general powers and roots, typically the root is the reciprocal of the power.

An input signal, preferably a full-wave rectified current signal $I_i$, is applied to a log converter 28 to produce a voltage signal $V_1$ whose amplitude is a logarithmic function of $I_i$. A multiplier 30 scales $V_1$ by a power factor of two to produce a voltage signal $V_2$ whose amplitude is a logarithmic function of the squared input signal $I_i$.

The log square voltage signal $V_2$ is then applied to a log filter 32, which approximates the "mean" operation and produces a voltage signal $V_3$ that is a logarithmic function of the mean-square of the input signal $I_i$. A multiplier 38 multiplies the log mean-square voltage signal $V_3$ by a root factor of one-half to produce a log RMS voltage signal $V_4$. An exponentiator 40 removes the logarithmic dependence of $V_4$, and produces an output signal $I_{out}$ that tracks the RMS value of the input signal $I_i$. A log RMS output is available by simply removing the exponentiator 40 and taking $V_4$ as the output, and a log mean-square output is provided by further removing the times one-half multiplier 38 and providing $V_3$ as the output.

The log filter 32 is preferably a first order low pass filter, although higher order filters can be used to improve the detector's approximation of the "mean" operation.

A general theory of log filters is disclosed by the present inventor, Douglas Frey, in "Log Domain Filtering: An Approach to Current Mode Filtering," IEE Proceedings, Pt. G, Vol. 140, No. 6, pp. 406–416, December 1993. For ease of explanation, the log filter 32 will be considered to compute the "mean" of the input signal, even though the result is an approximation. The log filter 32 has an integration period that can be set according to the specific requirements of the detector. For example, a short integration period is used to track the near instantaneous RMS value of the input signal $I_{in}$. Conversely, a longer integration period is used to compute the time-averaged RMS value of the input signal.

Figure 3:
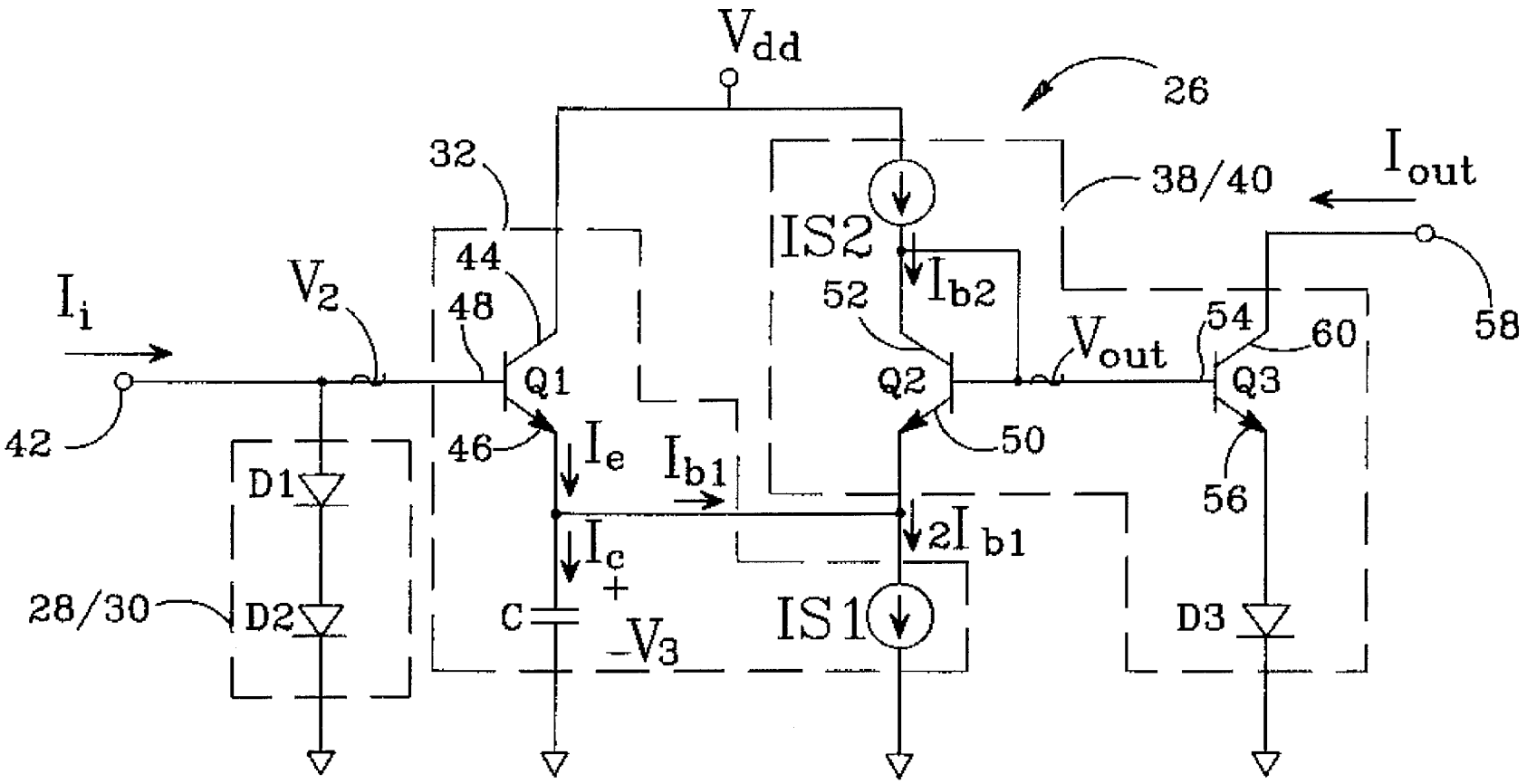
FIG. 3 is a schematic diagram illustrating a preferred circuit for implementing the RMS detector of FIG. 2.

FIG. 3 is a schematic diagram of a preferred explicit RMS detector 26 that produces an RMS output current $I_{out}$ in response to full-wave rectified input current $I_i$. In the preferred circuit the log and squaring functions provided by the log converter 28 and the times two multiplier 30 shown in FIG. 2 are combined into a log domain squaring circuit 28/30, the log filter 32 is a low pass filter, and the times one-half multiplier 38 and exponentiator 40 are combined into a log domain square-rooting circuit 38/40. To increase speed, preferably all of the transistors are NPN transistors and all of the diodes are diode connected NPN transistors.

The log domain squaring circuit 28/30 comprises diodes D1 and D2 that are connected in series between an input node 42 and ground. The input current $I_i$ is applied to the diodes to produce the log square voltage signal $V_2$ at the input node 42. In general, n diodes could be connected in series to effectively raise the input signal to the Nth power. The logarithmic nature of the diodes' I-V (current v. voltage) curves produces a voltage signal $V_2$ that is equivalent to the voltage signal created by the square of the input current $I_i$ flowing through a single diode normalized by the reverse saturation current. The voltage signal $V_2$ is given by:

$$V_2 = 2V_t \ln\left[\frac{I_i}{I_S}\right] = V_t \ln\left[\frac{I_i^2}{I_s^2}\right] \tag{1}$$

where $V_t$ is the thermal voltage and $I_s$ is the diode reverse saturation current. The relation described in equation 1 is valid in forward bias for the base-emitter voltage in a transistor as well as diodes. The diodes in the averaging circuit are preferably diode connected NPN transistors.

The log square voltage signal $V_2$ is applied to the low pass filter (lpf) 32, preferably a first order filter, which approximately performs the "mean" operation. The filter comprises an NPN transistor Q1 whose collector 44 is connected to a high voltage supply $V_{dd}$, an external capacitor C connected between the emitter 46 of Q1 and ground, and a current source IS1 which draws current from the Q1/C junction to ground. The voltage signal $V_2$ is applied to the base 48 of transistor Q1 such that a portion of its exponential emitter current $I_e$ is supplied to the capacitor C. The current source IS1 draws a bias current $I_{b1}$, suitably 3 μA, from $I_e$, producing a net capacitor current $I_c$ of ($I_e$–$I_{b1}$). When the emitter current exceeds the bias current, $I_c$ flows into the capacitor C and charges the capacitor to increase its voltage. Conversely, the capacitor C is discharged when the net current $I_c$ is negative.

The filter's cut-off frequency $\omega_0$ is set by the capacitance of capacitor C, which is nominally 10 μF. Larger values of C increase the integration time and reduces the cut-off frequency. Conversely, smaller values of C reduce the integration time and increase the cut-off frequency. In general, the frequency response of a low pass filter is described by the differential equation:

$$\frac{dX}{dt} = -\omega_0 X + \omega_0 I(t) \tag{2}$$

where I(t) is the input to the filter and X is its time response. To a first order approximation, the time response X equals the mean of the input I(t).

The voltage $V_3$ across the capacitor C, ignoring the effects of base current, can be derived from the following equations:

$$I_c = C\frac{dV_3}{dt} = I_S e^{(V_2-V_3)/V_t} - I_{b1} \tag{3}$$

Rearranging equation 3, $$\frac{1}{V_t}\frac{dV_3}{dt} e^{V_3/V_t} = -\frac{I_{b1}}{CV_t} e^{V_3/V_t} + \frac{I_S}{CV_t} e^{V_2/V_t} \tag{4}$$

Substituting $X=e^{V_3/V_t}$ in equation 4 and combining equations 1 and 4 gives:

$$\frac{dX}{dt} = -\frac{I_{b1}}{CV_t} X + \frac{I_S}{CV_t}\frac{I_i^2}{I_S^2} \tag{5}$$

$$\frac{dX}{dt} = -\omega_0 X + \omega_0 \frac{I_i^2}{I_{b1} I_S} \tag{6}$$

where $\omega_0 = \frac{I_{b1}}{CV_t}$.

Equation 6 is a differential equation that describes the frequency response of the lowpass filter 32, where X is the time response of the filter 32 to an input $$\frac{I_i^2}{I_{b1} I_S}.$$

Therefore, to a first-order approximation, $$X = \text{mean}\left(\frac{I_i^2}{I_{b1} I_S}\right) = \frac{1}{I_{b1} I_S}\text{mean}(I_i^2) \tag{7}$$

Substituting equation 7 into $X=e^{V_3/V_t}$ gives:

$$V_3 = V_t \ln\left(\frac{1}{I_{b1} I_S}\text{mean}(I_i^2)\right) \tag{8}$$

Thus, the capacitor voltage $V_3$ is a logarithmic function of the mean-square of the input current $I_i$.

The log domain square-rooting circuit 38/40 comprises a diode connected NPN transistor Q2 whose emitter 50 is connected to the Q1/C junction for level shifting the capacitor voltage V3 to offset the base-emitter drop across Q1. A current source IS2, connected between the high voltage supply $V_{dd}$ and the collector 52 of transistor Q2, supplies bias current $I_{b2}$ to the transistor Q2.

The level shifted output voltage $V_{out}$ at the base-collector junction of Q2 is given by:

$$V_{out} = V_3 + V_t \ln\left[\frac{I_{b2}}{I_S}\right] \tag{9}$$

The level shifted voltage $V_{out}$ is applied to the base 54 of an NPN transistor Q3 whose emitter 56 is connected to the anode of a diode D3. D3's cathode is connected to ground. The transistor Q3 and diode D3 square-root and exponentiate the shifted voltage $V_{out}$ so that the RMS output current $I_{out}$ is provided at an output node 58 at Q3's collector 60 and flows through transistor Q3 and diode D3. In the general case, the $m^{th}$ root can be computed by connecting m-1 diodes in series between the emitter of Q3 and ground. Typically, the number of diodes connected between the input node 42 and ground is one more than the number connected between the emitter of Q3 and ground such that the root factor is the reciprocal of the power factor.

The output voltage $V_{out}$ can also be described as the voltage across the series combination of transistor Q3 and diode D3, which is given by:

$$V_{out} = V_t \ln\left[\frac{I_{out}^2}{I_s^2}\right] \tag{10}$$

Solving equation 10 for $I_{out}$ and substituting equations 8 and 9 yields:

$$I_{out}^2 = I_{b2} I_s X \tag{11}$$

The derivation assumes that the bias currents are equal ($I_{b1}=I_{b2}$). Otherwise the output current $I_{out}$ would be multiplied by a constant equal to the square root of the bias current $I_{b2}$ divided by $I_{b1}$. Ignoring base currents, the current source IS1 has a value of $I_{b1}+I_{b2}=2I_{b2}$ to sink the bias current from the emitter of transistor Q2 and supply the bias current for the capacitor C.

Substituting equation 6 into equation 10 and letting $I_{b1}=I_{b2}$ gives the final result, $$I_{out}=\sqrt{\text{mean}(I_i^2)} \tag{11}$$

The explicit log domain RMS detector provides an RMS output current $I_{out}$ and a log RMS output voltage $V_{out}$. The topology increases the detector's bandwidth by eliminating the feedback structure of the prior art, maintains its dynamic range by processing the signals in the log domain which compresses the signals, and improves its accuracy by reducing the number of components. The detector's integration time can be varied independent of the signal level by changing the value of the capacitor and/or by changing the bias currents $I_{b1}$ and $I_{b2}$. Furthermore, the low pass filter can be a second, third or $n^{th}$ order filter, which would improve the accuracy of the "mean" computation at the cost of additional components.

While an illustrative embodiment of the invention has been shown and described, numerous variations and alternate embodiments will occur to those skilled in the art. Such variations and alternate embodiments are contemplated, and can be made without departing from the spirit and scope of the invention as defined in the appended claims.

I claim:

1. A circuit for detecting the root-mean-square (RMS) of an input current signal, comprising;

an input node for receiving said input current signal;

a low voltage supply node;

first and second diodes that are connected in series between said input node and said low voltage supply node, said input current signal flowing through said diodes to produce a first voltage signal at said input node that is a logarithmic function of the squared input current signal;

a first transistor for producing an exponential current in response to said first voltage signal;

a first current source for supplying a first bias current that subtracts from said exponential current to produce a capacitor current;

a capacitor that is charged by said capacitor current when said exponential current is greater than said bias current and is discharged by said capacitor current when said exponential current is less than said bias current to produce a second voltage signal that is a logarithmic function of the mean-square of the input current signal;

a second transistor for level shifting said second voltage signal;

a second current source for supplying a second bias current that flows through said second transistor to said first current source, said first and second bias currents being substantially equal;

a third transistor having a base and a collector-emitter circuit; and a third diode that is connected between said third transistor's collector-emitter circuit and said low voltage supply node, said level shifted second voltage signal being applied to said base of said third transistor to produce an output current signal that approximates the root-mean-square of said input current signal.

2. A circuit for detecting an input current signal, comprising:

an input node for receiving said input current signal;

a ground node:

first and second diodes that are connected in series between said input node and said ground node, said input current signal flowing through said diodes to produce a first voltage signal at said input node that represents the square of the input current signal in a log domain;

a first NPN transistor for producing an exponential current in response to said first voltage signal;

a first current for supplying a first bias current that subtracts from said exponential current to produce a capacitor current;

a capacitor that is charged by said capacitor current when said exponential current is greater than said bias current and is discharged by said capacitor current when said exponential current is less than said bias current to produce a second voltage signal that represents the mean-square of the input current signal in the log domain;

a second diode connected NPN transistor for level shifting said second voltage signal;

a third transistor having a base, a collector, and an emitter; and a third diode that is connected between said third transistor's emitter circuit and said ground node, said level shifted second voltage signal being applied to said base of said third transistor to produce an output current signal at its collector that represents a root-mean-square of said input current signal; and a second current source for supplying a second bias current that flows through said second diode connected NPN transistor to said first current source, said first and second bias currents being substantially equal so that said output current signal is approximately equal to the root-mean-square of said input current signal.

* * * * *